United States Patent [19]

List

[11] 4,166,629

[45] Sep. 4, 1979

[54] SKATEBOARD TRUCK

[76] Inventor: Richard A. List, 177-F Riverside Ave., Newport Beach, Calif. 92663

[21] Appl. No.: 853,572

[22] Filed: Nov. 21, 1977

[51] Int. Cl.[2] ..... A63C 17/02

[52] U.S. Cl. ..... 280/11.28; 280/87.04 A

[58] Field of Search ..... 280/11.28, 11.27, 11.19, 280/87.04 A, 87.04 R, 11.3

[56] References Cited

U.S. PATENT DOCUMENTS

| | | | |
|---|---|---|---|
| 155,533 | 9/1874 | Luce | 280/11.3 |
| 645,270 | 3/1900 | Richardson | 280/11.28 |
| 2,330,338 | 9/1943 | Dekome et al. | 280/11.28 |
| 2,547,796 | 4/1951 | Swensson | 280/11.28 |
| 2,554,062 | 5/1951 | Sefferino | 280/11.28 |
| 3,104,887 | 9/1963 | Rice et al. | 280/11.28 |
| 3,862,763 | 1/1975 | Ware | 280/11.28 |
| 4,060,253 | 11/1977 | Oldendorf | 280/11.28 |

FOREIGN PATENT DOCUMENTS

D. 14324 11/1956 Fed. Rep. of Germany ..... 280/11.28

OTHER PUBLICATIONS

"1971 Fastening and Joining Reference Issue", Machine Design, Nov. 18, 1971, p. 74.

*Primary Examiner*—David M. Mitchell
*Attorney, Agent, or Firm*—Armstrong, Nikaido, Marmelstein & Kubovcik

[57] ABSTRACT

A skateboard truck is provided which comprises a base a hanger and a coupling assembly. The base has a first portion with a first hole therein and a second portion with a second hole therethrough. The hanger has an axle for mounting wheels thereon, a ring and a pin, the pin being received in the first hole. The axis of the pin coincides with the axis of the first hole and passes through the center of the ring. The coupling assembly is provided for coupling the hanger to the base, the coupling assembly passing through the ring and being received in the second hole.

5 Claims, 5 Drawing Figures

SKATEBOARD TRUCK

BACKGROUND OF THE INVENTION

1. Field of the Invention

The present invention is directed to a skateboard truck and in particular to a skateboard truck in which the elements of a hanger are aligned in such a manner as to produce perfect rotation thereby reducing binding, wearing and breaking thereof.

2. Description of the Prior Art

A skateboard truck is that portion of the skateboard which carries the wheels and which is mounted onto the board itself. A rider applies his weight to the truck and the hanger of the truck pivots on the base, allowing the rider to turn left or right.

In skateboard trucks, the hanger is mounted on the base by means of a pin which is seated in a hole in the base and by a bolt which passes through a ring in the hanger and which is threaded into another hole in the base. In prior art skateboard trucks, there is no alignment between the axis of the pin and the center of the ring. Therefore, when the hanger pivots, forces are applied to the pin and to the hole in the base in which it is received which are lateral with respect to the axis of the pin. These forces cause binding and wearing of the pin, the hole in the base in which it is received and a bushing which is placed in the hole. In addition, stresses are placed on the hanger itself which can result in breaking.

As a result of the wearing and breakage which occurs because of the misalignment, a potentially dangerous situation is created which could result in severe injury to an individual using a skateboard.

Another significant factor in skateboard trucks is the weight of the truck itself. An ideal material would be one which is lightweight, very strong, and relatively inexpensive. In the prior art, metals such as aluminum have been used; however, if a mounting bolt is screw-threaded into an aluminum base, the stresses caused when turning can result in the stripping of the screw threads, which would then allow the mounting bolt to loosen and again create a potentially dangerous situation.

SUMMARY OF THE INVENTION

It is an object of the present invention to provide a skateboard truck which has a hanger wherein the axis of the pin of the hanger passes through the center of the ring of the hanger, thereby allowing the pivoting of the hanger to be about this axis which will eliminate binding, wearing and breaking as is found in prior art skateboard hangers.

It is another object of the present invention to use a steel such as a Heli-coil insert in the aluminum alloy baseplate of the skateboard truck whereby stripping of the threads which hold the mounting bolt is substantially eliminated.

It is still a further object of the present invention to provide a safe skateboard truck which substantially reduces failures by eliminating the causes of the failures, as compared to prior art skateboard trucks.

The present invention is directed to a skateboard truck which comprises a base, a hanger and a coupling assembly for coupling the hanger to the base. The base includes a first portion with a first hole therein and a second portion with a second hole therethrough. The hanger has an axle for mounting wheels thereon, a ring and a pin with the pin being received in the first hole and wherein the axis of the pin coincides with the axis of the first hole and passes through the center of the ring. The coupling means includes a bolt with rubber bushings therearound, the bolt passing through the ring with the bushings on each side thereof, the bolt being threaded into a steel wire thread insert in the second hole of the base.

DETAILED DESCRIPTION OF THE PREFERRED EMBODIMENT

Figure 1:
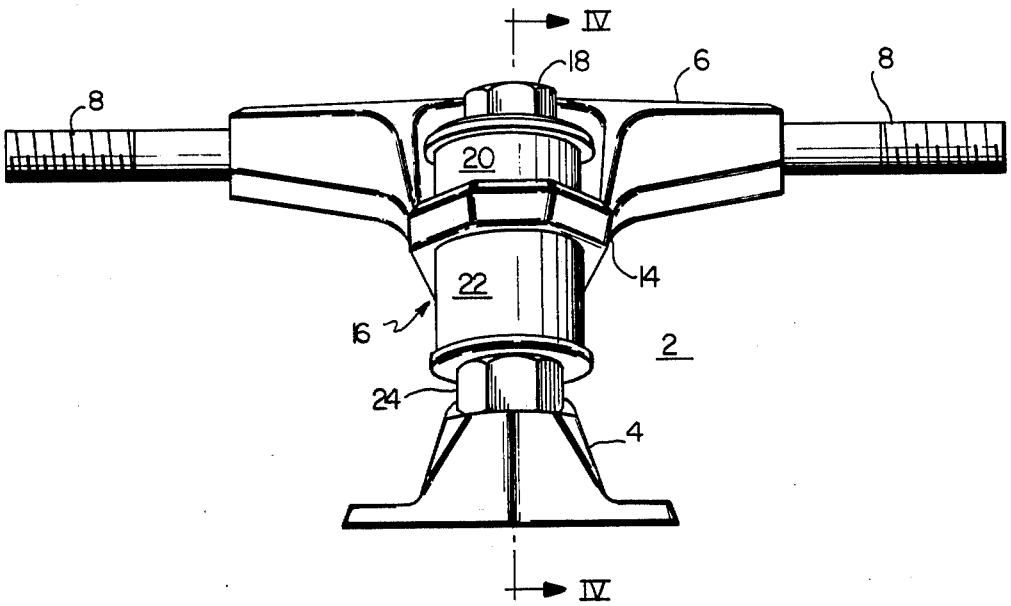
FIG. 1 is a rear elevation of a skateboard truck of the present invention.
Figure 2:
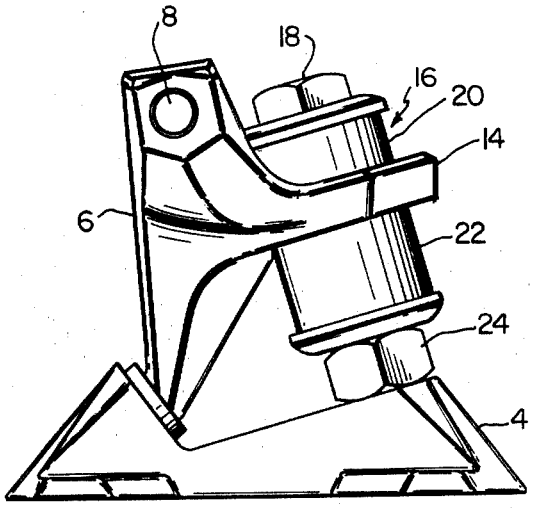
FIG. 2 is a side elevation of a skateboard truck of the present invention.
Figure 4:
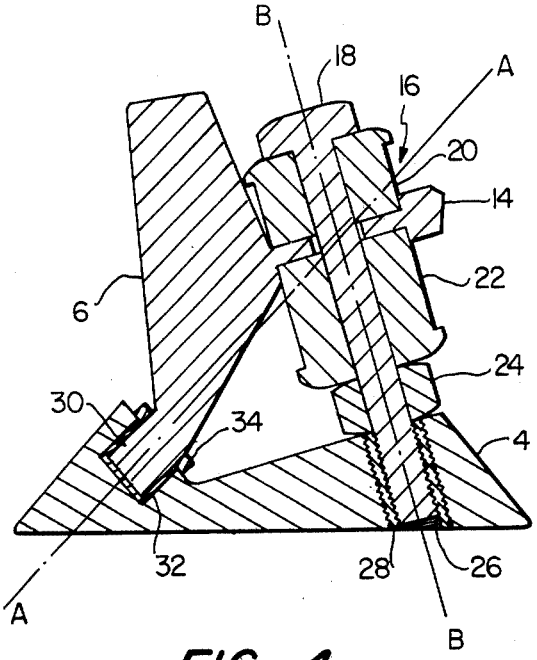
FIG. 4 is a section through line IV—IV in FIG. 1.

Referring to the drawings, skateboard truck 2 includes a base 4 and a carrier 6. The carrier 6 has axles 8 extending therefrom upon which wheels (not shown) are mounted. The base 4 is mounted to a skateboard (not shown) by placing the bottom surface 10 of the base on the underside of the board and fixing it thereto by the insertion of screws through holes 12.

The carrier 6 includes a circular ring 14 having a hole 15 therein through which a coupling assembly 16 passes to couple the hanger to the base. The coupling assembly 16 includes a main bolt 18 which has a first rubber bushing 20 around the upper portion thereof and a second rubber bushing 22 around the lower portion thereof, with the ring 14 being positioned between the bushings. The rubber bushings are held in place by means of a nut 24 on the bolt 18. The end of the bolt 18 is screwed into a hole 26 in the base 4. A steel wire thread insert 28 such as a heli-coil is inserted in the hole 26 in order to strengthen the threads which are engaged by the bolt 18. The heli-coil 2 is used because base 4 is an aluminum alloy and if the bolt 18 were secured by threading the aluminum alloy in hole 26, they would be subject to stripping. The heli-coil insert eliminates the stripping problem.

In addition to the ring 14, the hanger 6 also includes a pin 30 which is inserted into a hole 32 in the base 4. A bushing 34 is inserted in the hole 32 between the pin and the periphery of the hole. The axis A—A of the pin 30 is coincident with the axis of the hole 32 and passes through the center C of the hole 15 in the ring 14. The center C of the hole 15 lies on the axis B—B which is coincident to the axis of hole 26.

Figure 5:
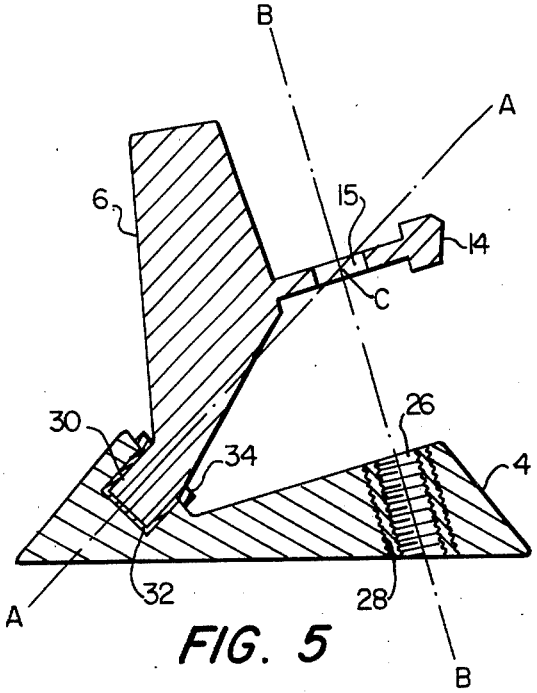
FIG. 5 is a sectional view through the line IV—IV in FIG. 1, with the mounting assembly not being shown.
Figure 3:
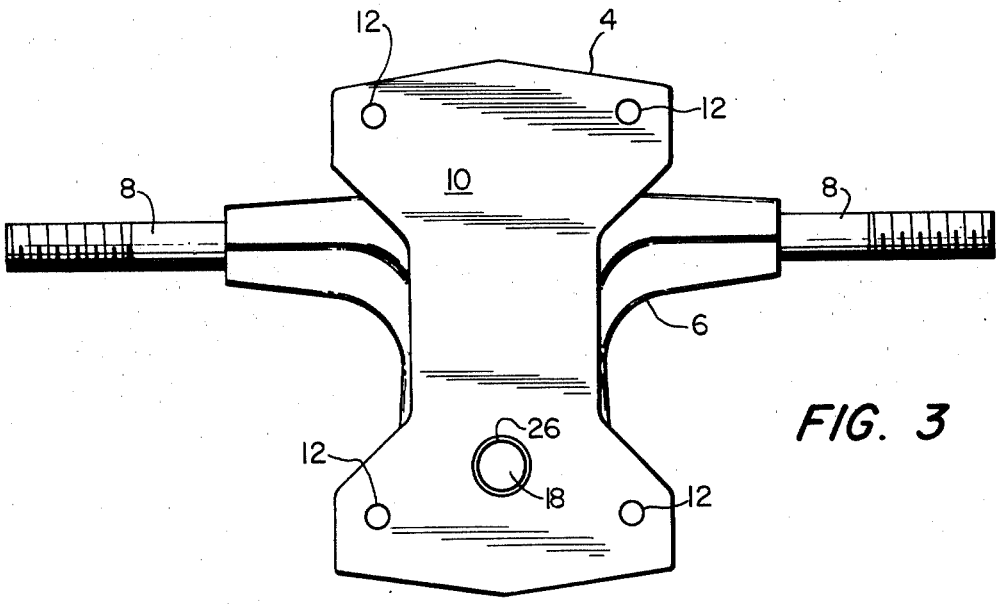
FIG. 3 is a bottom view of a skateboard truck of the present invention.

As can be seen especially in FIGS. 5 and 6, when the hanger 6 rotates about axis A—A of the pin 30 in the hole 32, the ring 14 rotates about axis A—A and therefore, lateral movement of the pin and the ring is substantially eliminated, thus reducing wear and stress on the pin, the ring and the coupling assembly 16.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

I claim:

1. A skateboard truck comprising:

(a) a base, said base having a first portion with a first hole therein and a second portion with a second hole therethrough said first hole having an axis passing longitudinally through the center thereof;

(b) a hanger, said hanger having an axle for mounting wheels thereon, a ring means having a third hole therethrough; said third hole having a center positioned midway between the sides of the ring at the edges of said hole on a second longitudinal axis through said third hole and said second hole, and a pin means having an axis passing longitudinally through the center thereof, said pin means being received in said first hole wherein the axis of said pin means coincides with the axis of said first hole and wherein the axis of said pin means and said first hole pass through the center of the third hole of said ring means at an angle with respect to the plane of the third hole of said ring means; and (c) coupling means for coupling said hanger to said base, said coupling means passing on said second longitudinal axis through the third hole of said ring means and being received in said second hole of said base.

2. A skateboard truck as set forth in claim 1 including a bushing in said first hole positioned between said pin means and the periphery of said first hole.

3. A skateboard truck as set forth in claim 1 wherein said coupling means comprises a bolt, a first rubber member positioned on said bolt between the head of said bolt and said ring means, and a second rubber member positioned between said ring means and said second portion of said base, wherein said bolt is screwed into said second hole of said base.

4. A skateboard truck as set forth in claim 3 including a wire thread insert means in said second hole for providing threads for engaging the threads on said bolt.

5. A skateboard truck as set forth in claim 4 including a nut screwed onto said bolt between said second rubber assembly and said second portion of said base.

* * * * *